US005975414A

United States Patent [19]

Stacy-Ryan et al.

[11] Patent Number: 5,975,414

[45] Date of Patent: Nov. 2, 1999

[54] CARTON WITH A GABLE TOP HAVING A TRIANGULAR FACE WITH A FITMENT THEREON AND A BLANK FOR THE SAME

[75] Inventors: Russell Stacy-Ryan, Chicago; Sheila Moss, Barrington, both of Ill.

[73] Assignee: Tetra Laval Holdings & Finance, SA, Pully, Switzerland

[21] Appl. No.: 09/199,898

[22] Filed: Nov. 25, 1998

[51] Int. Cl.[6] ..... B65D 5/08

[52] U.S. Cl. ..... 229/125.15; 229/137

[58] Field of Search ..... 229/125.04, 125.14, 229/125.15, 137, 125.42; 222/553, 554, 556, 562

[56] References Cited

U.S. PATENT DOCUMENTS

| | | | |
|---|---|---|---|
| 4,819,865 | 4/1989 | Lisiecki et al. | 229/137 |
| 4,971,243 | 11/1990 | Lisiecki et al. | 229/125.15 |
| 5,065,938 | 11/1991 | Anderson | 229/125.08 |
| 5,069,385 | 12/1991 | Farber | 229/137 |
| 5,152,438 | 10/1992 | Gordon et al. | 229/125.14 |
| 5,350,110 | 9/1994 | Will | 229/125.15 |
| 5,509,585 | 4/1996 | Mock et al. | 229/125.15 |
| 5,564,621 | 10/1996 | Writt | 229/125.42 |
| 5,636,785 | 6/1997 | Kalberer et al. | 229/125.15 |
| 5,735,426 | 4/1998 | Babcock et al. | 229/125.15 |
| 5,785,240 | 7/1998 | Showler et al. | 229/125.15 |

FOREIGN PATENT DOCUMENTS

| | | | |
|---|---|---|---|
| 712906 | 7/1965 | Canada | 229/125.15 |
| 2659275 | 7/1978 | Germany | 229/125.42 |
| 2099402 | 12/1982 | United Kingdom | 229/137 |

*Primary Examiner*—Gary E. Elkins

[57] ABSTRACT

The present invention is a carton with a fitment disposed where cartons without fitments conventionally were opened for accessing the contents. The carton has a truncated gable top with a triangular face upon which lies the fitment. The pouring of the product from the carton is similar to the traditional pouring operation from gable top cartons without fitments.

7 Claims, 10 Drawing Sheets

CARTON WITH A GABLE TOP HAVING A TRIANGULAR FACE WITH A FITMENT THEREON AND A BLANK FOR THE SAME

BACKGROUND OF THE INVENTION

1. Field of the Invention

The present invention relates to gable-top cartons with fitments thereon for accessing the product therein. Specifically, the present invention relates to gable top cartons and carton blanks therefor.

2. Description of the Related Art

The traditional gable top carton was accessed by tearing opening one of the non-gable sides and creating the integrated pour spout from the top panels to dispense the product contained therein. However, it is become rare to find a gable top carton without a fitment thereon for accessing the product within the carton. Products from orange juice to coffee creamers have migrated towards cartons with fitments (plastic reseable closures) to distinguish these products from products packaged in the traditional gable top carton (without a fitment), and to provide the consumer with a way to reseal the package with some degree of certainty. For the most part, these fitments have been placed on one of the gable panels of the top of the carton.

U.S. Pat. No. 5,065,938 to Anderson discloses a carton with the fitment (reseable pouring spout) on one of the non-gable panels. In Anderson, the fitment is bridged by the gable panels which act as a tamper evidence means. Also, the fitment cannot be opened without opening the gable panels. And the fitment is oriented to have the cap open downward to effect this tamper-proof means.

BRIEF SUMMARY OF THE INVENTION

It is a primary object of the present invention to provide a carton with a fitment located in a traditional spout area.

It is a further object of the present invention to provide a carton having a top triangular panel with a fitment thereon.

It is a further object of the present invention to provide a blank for a carton with a fitment located in a traditional spout area.

One aspect of the present invention is a carton for a liquid food product. The carton includes first, second, third and fourth side panels. The first side panel is opposite the third side panel and the second side panel is opposite the fourth side panel. The carton also includes first and second angled top panels. The first angled top panel is adjacent the first side panel and the second angled top panel is adjacent the third side panel. Each of the angled top panels have a diagonal edge and a fin panel. Each of the fin panels engage each other to form a top fin that extends along a portion of a central plane of the carton. The carton also includes a triangular top panel which has first, second and third edges. The first edge is adjacent the second side panel, the second edge engages the diagonal edge of the first top panel, and the third edge engages the diagonal edge of the second top panel. The triangular top panel has an aperture therethrough for accessing the liquid food product. The carton also includes a closure disposed on the triangular top panel, with the closure covering the aperture.

Another aspect of the present invention is blank for fabrication into a carton for a liquid for product. The blank includes first, second, third and fourth side panels partitioned from each other by a plurality of vertical score lines. The blank also includes first, second, third and fourth top panels respectively adjacent the first, second, third and fourth side panels and separate therefrom by a horizontal score line. The first, second, third and fourth top panels are partitioned from each other by the plurality of vertical score lines. The second top panel has first and second diagonal score lines intersecting each other at one end and intersecting a vertical score line of the plurality of vertical score lines at the other end. The second top panel also has an aperture therethrough. The second top panel also has a top fin panel with the top fin panel divided by a top fin vertical score line and having an edge with a depressive cut-out centered on the top fin vertical score line.

Having briefly described this invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention is a novel modification on the traditional gable top carton. The present invention redesigns the top of the carton to provide for access to the product contained within the carton through a fitment disposed where a consumer would conventionally access the product from a carton without a fitment. However, the present invention is much more than the positioning of a fitment.

Figure 1:
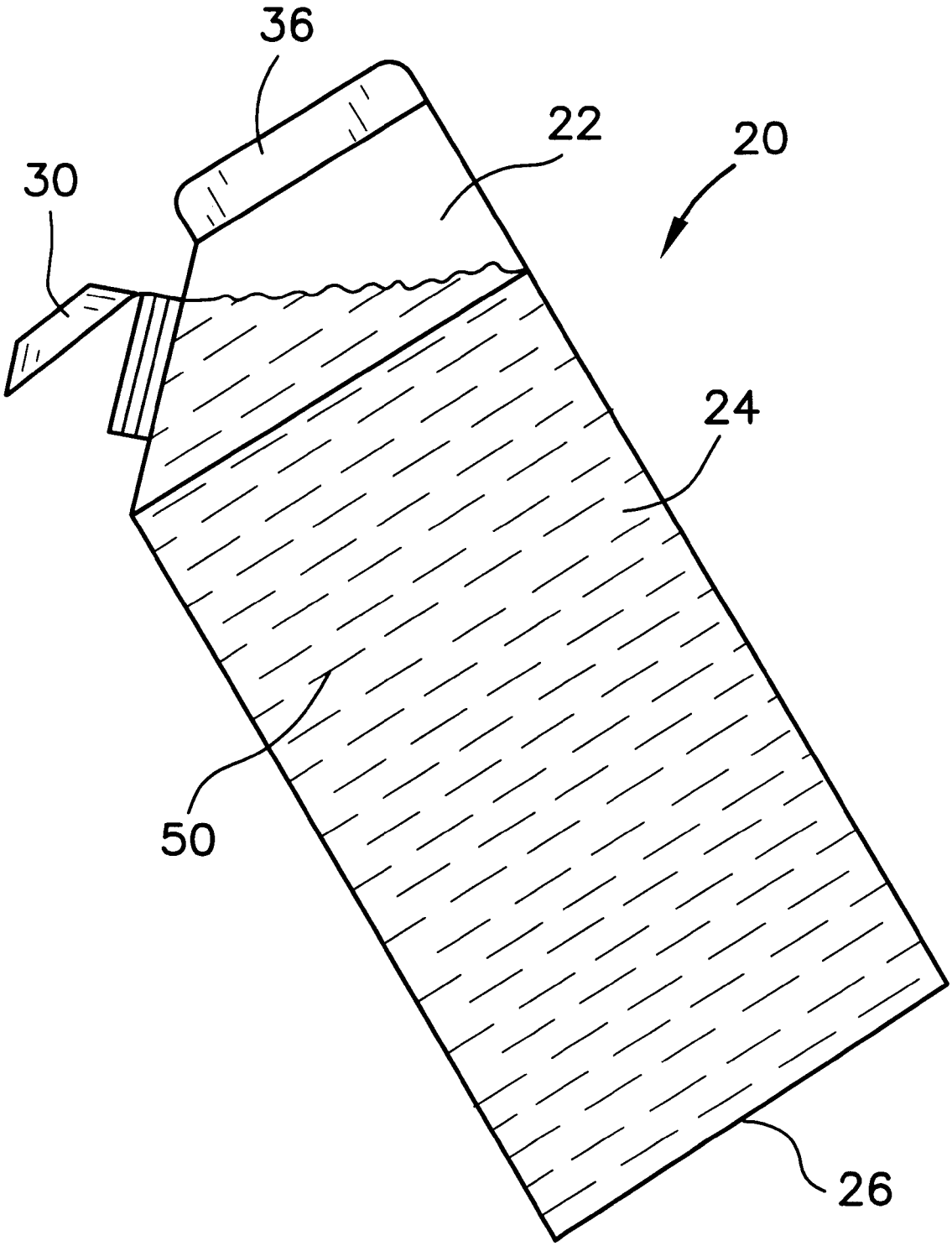
FIG. 1 is a perspective of a carton of the present invention.
Figure 1A:
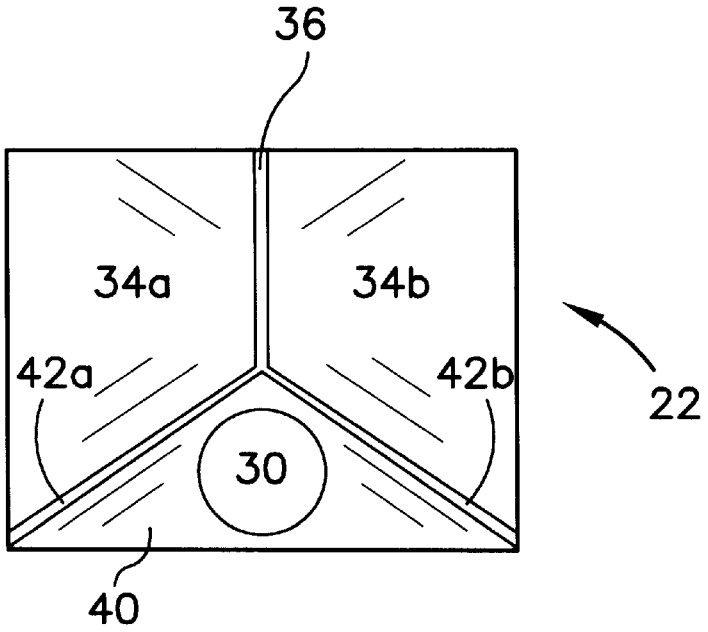
FIG. 1A is a top plane view of the carton of FIG. 1.
Figure 1B:
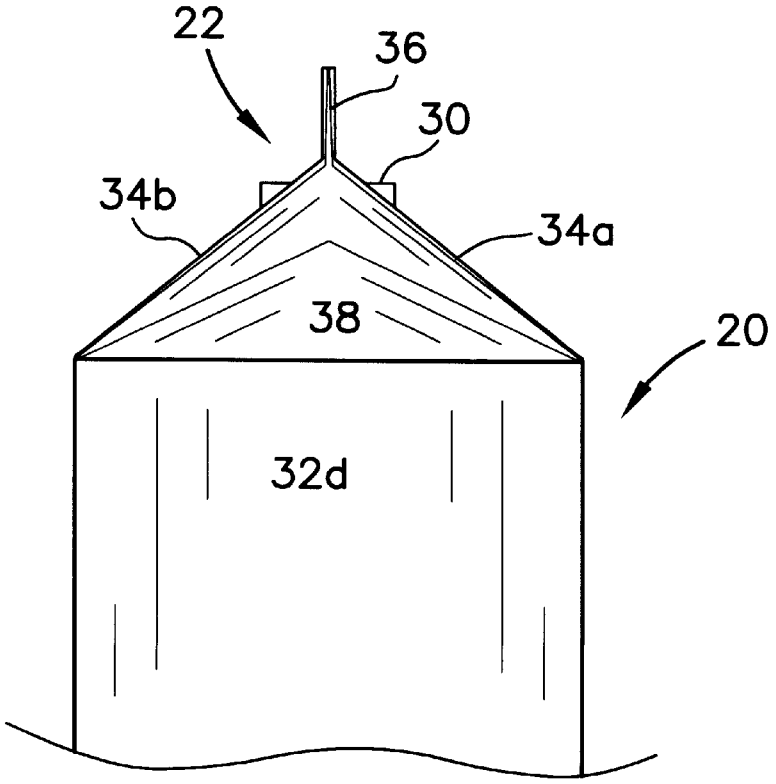
FIG. 1B is a rear plan view of the carton of FIG. 1.

As shown in FIGS. 1, 1A and 1B, the carton 20 has a top 22, a body 24 and a bottom 26. The body is defined by a plurality of side panels 32*a–d,* and may have a square cross-section, a rectangular cross-section, an octagonal cross-section, a hexagonal cross-section, or the like. The top 22 has a top fin 36 and a fitment 30 attached thereon for accessing the product 50. The top 22*a* includes angled top panels 34*a–b* are respectively adjacent side panels 32*a* and 32*c*. The angled top panels 34*a–b* meet to form the top fin 36. A triangular top panel 40 is disposed between the angled top panels 34*a–b,* and forms a triangular face on one side of the top 22 of the carton 20. An inward top panel 38 is bridged by the angled top panels 34*a–b*. The fitment 30 shown in FIG. 1 is a flip cap closure. Such a flip-cap closure is described in U.S. Pat. No. 5,799,840 entitled Closure Formed As A Single Integral Part and hereby incorporated by reference. The unique configuration of the top 22 allows for smoother pouring of the product from the carton 20 through the fitment 30.

Figure 2:
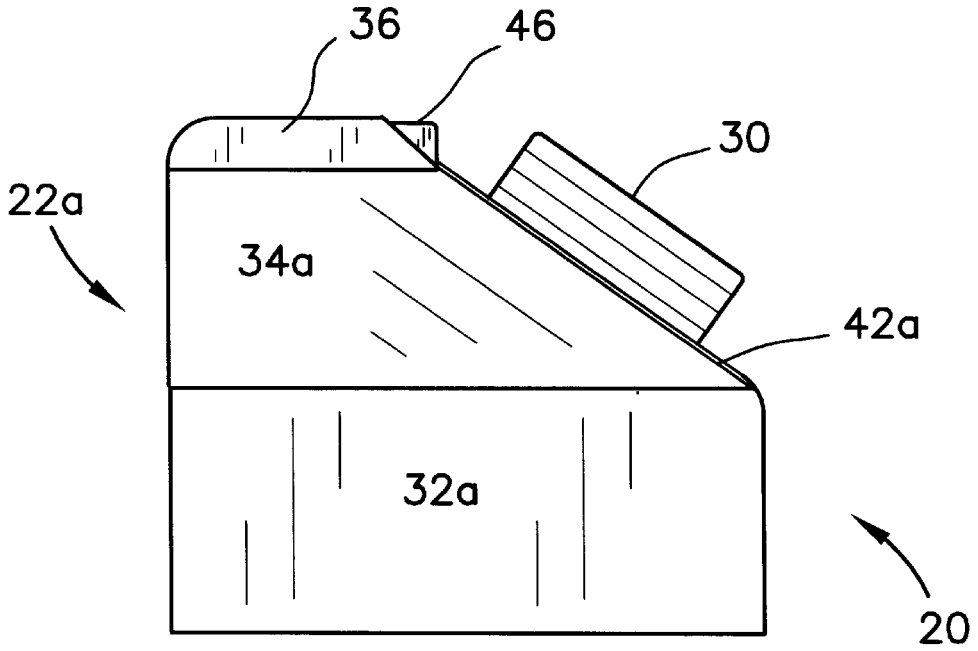
FIG. 2 is an isolated side plan view of a preferred embodiment of the top of the carton of the present invention.
Figure 2A:
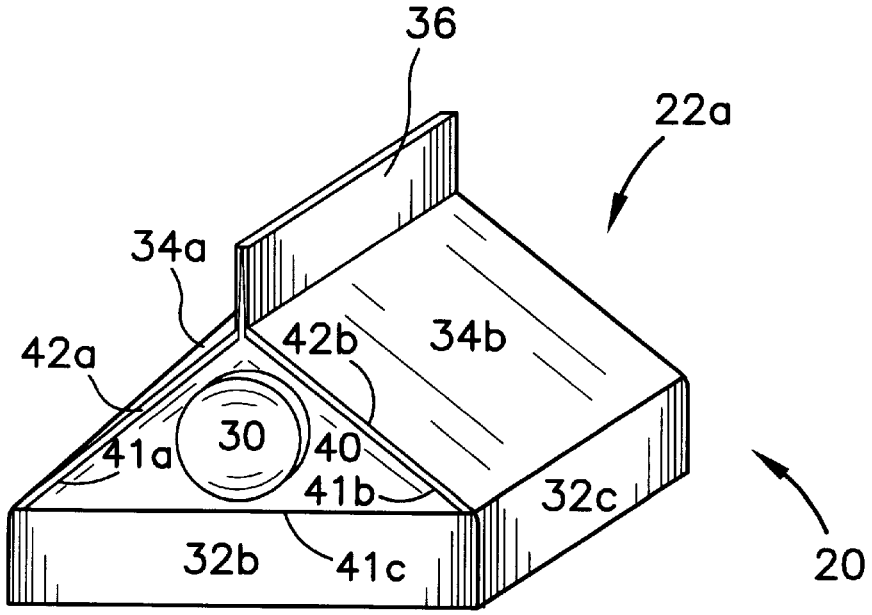
FIG. 2A is a top perspective view of the carton of FIG. 2.

FIGS. 2 and 2A illustrate a preferred embodiment of the carton 22 of the present invention. The triangular face/panel 40 is at approximately a forty-five degree angle. The unobstructed triangular panel 40 has the fitment 30 disposed thereon for easy access to the product 50 contained within the carton 20. The triangular panel 40 has three edges 41*a–c*. A first edge 41*a* is adjacent the angled top panel 34*a,* and a fold line 42*a* defines the intersection of the angled top panel 34*a* and the triangular panel 40. A second edge 41*b* is adjacent the angled top panel 34*b,* and a fold line 42*b* defines the intersection of the angled top panel 34*b* and the triangular panel 40. A third edge 41*c* is adjacent a side panel 32*b*. The length of the top fin 36 is less than half of the length of a top fin of a traditional gable top carton. In this embodiment, an additional fin panel 46 extends out from the top fin 36.

Figure 3:
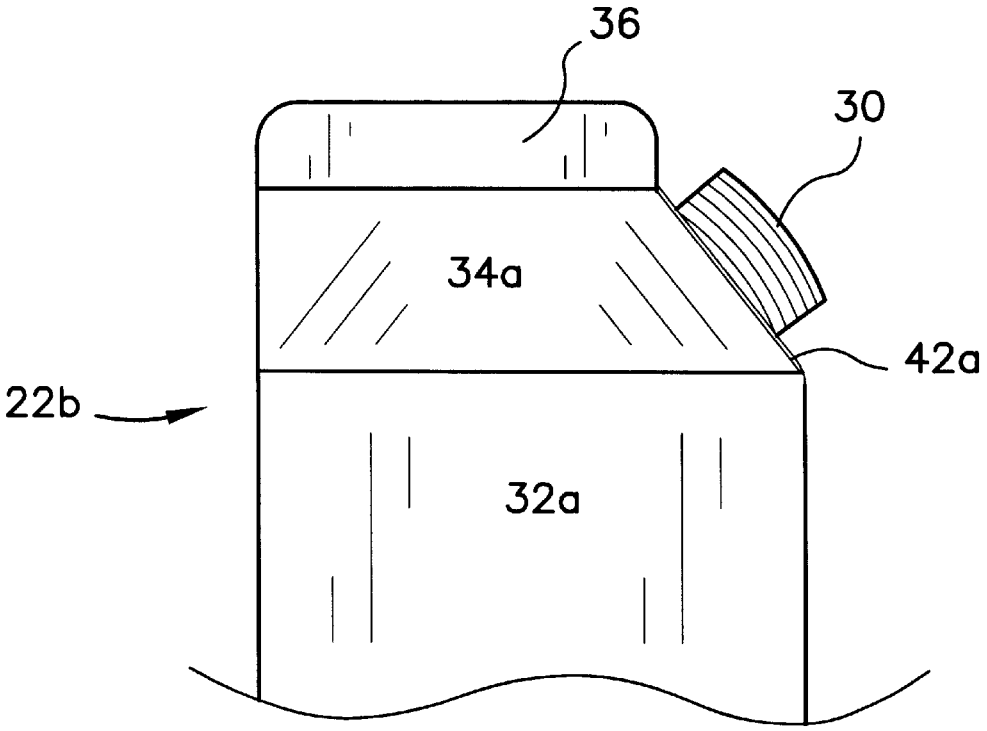
FIG. 3 is an isolated side plan view of an alternative embodiment of the top of the carton of the present invention.
Figure 3A:
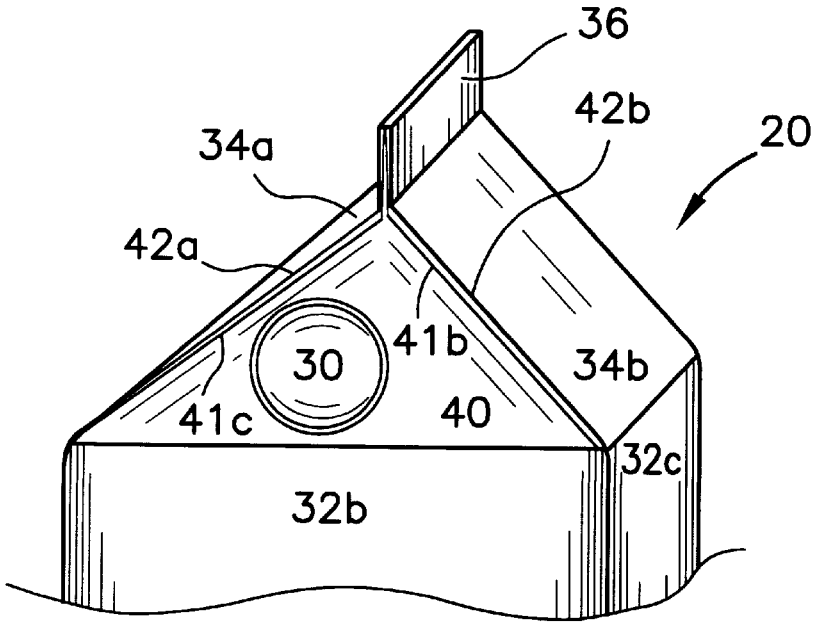
FIG. 3A is a top perspective view of the carton of FIG. 3.

An alternative embodiment is shown in FIGS. 3 and 3A. This embodiment is very similar to the embodiment shown in FIGS. 2 and 2A, however, the top fin has a greater length and the angle of the triangular face/panel 40 is greater than forty-five degrees and approximately sixty degrees.

Figure 4:
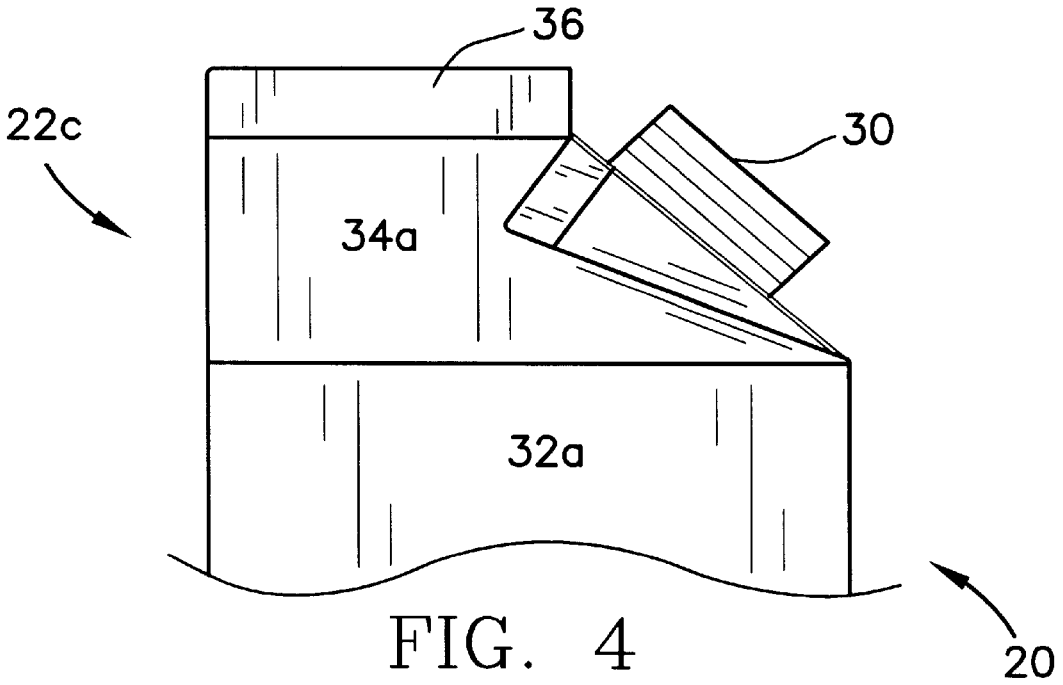
FIG. 4 is an isolated side plan view of an alternative embodiment of the top of the carton of the present invention.
Figure 4A:
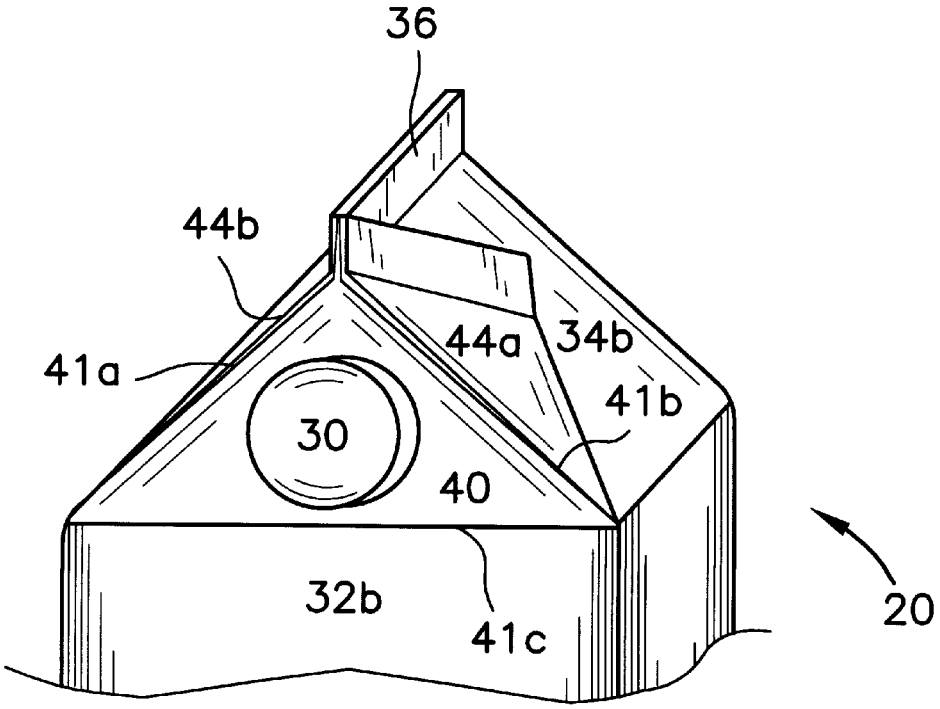
FIG. 4A is a top perspective view of the carton of FIG. 4.

Yet another alternative embodiment is shown in FIGS. 4 and 4A. In this embodiment, the folding flaps 44*a–b* are not folded inward, and are sealed to their respective angled top panels 34*a–b*. The edges 41*a–b* of the triangular panel 40 are adjacent the folding flaps 441-*b* and the angled top panels 34*a–b*.

Figure 5:
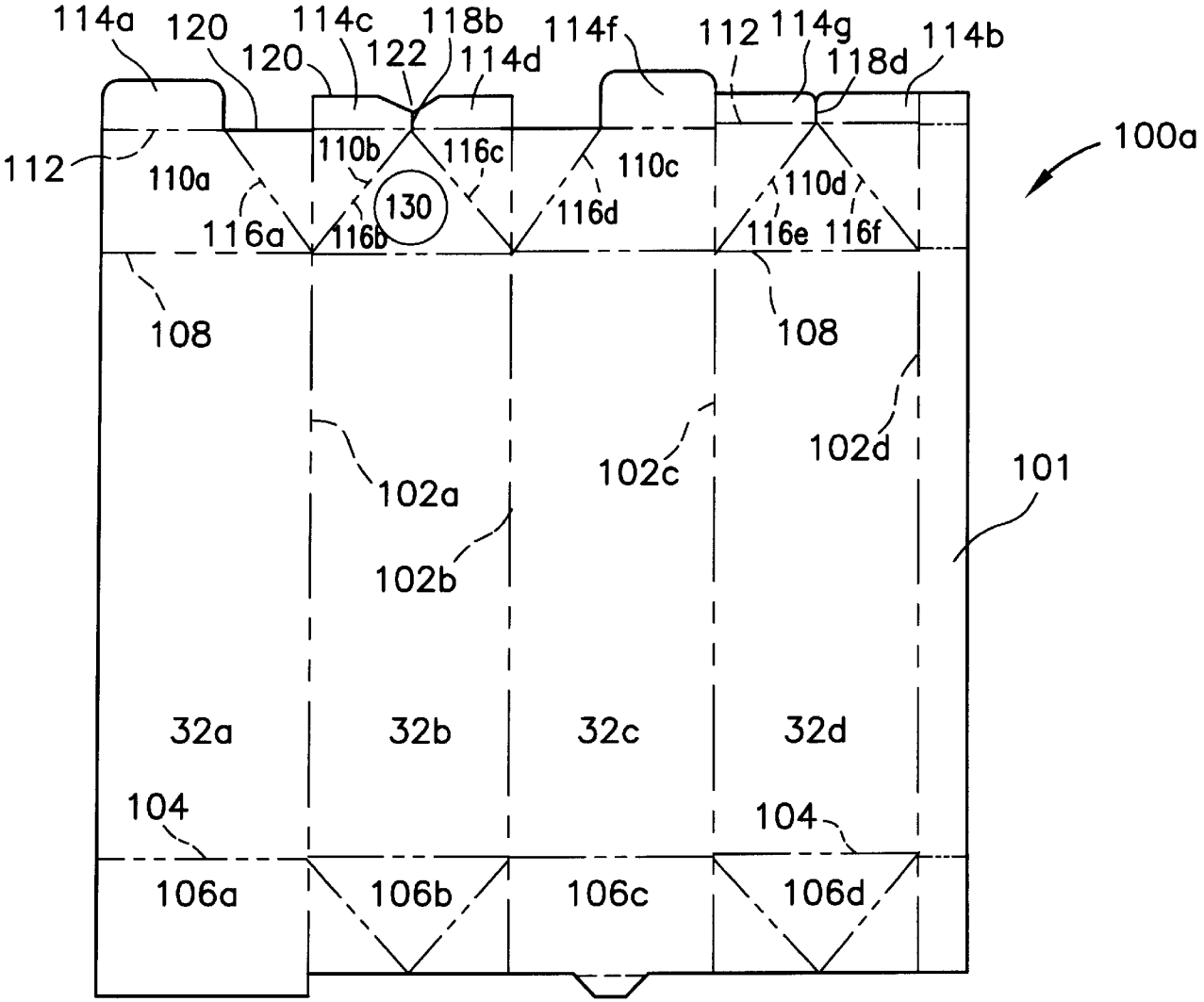
FIG. 5 is a carton blank of the present invention.
Figure 6:
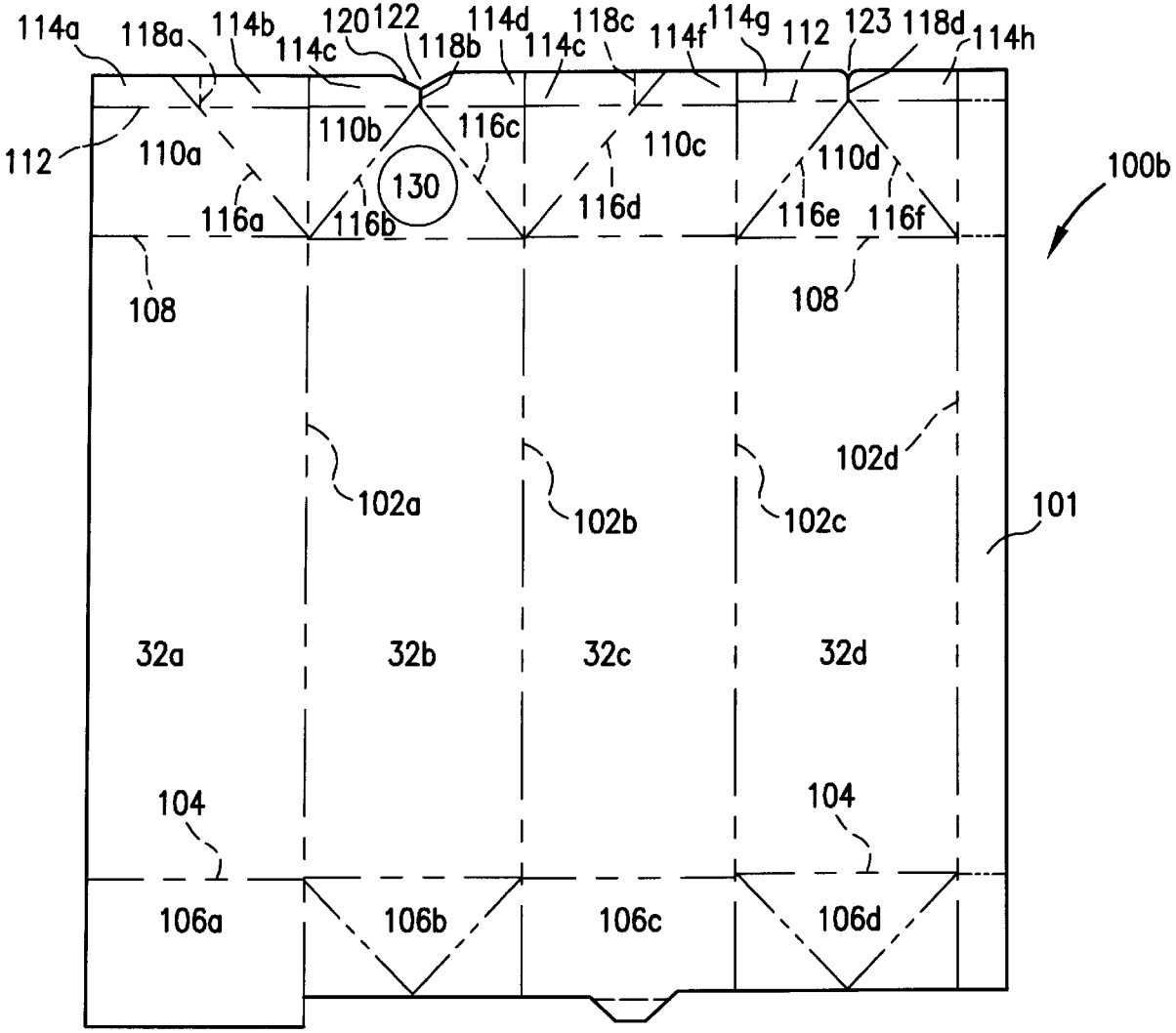
FIG. 6 is an alternative embodiment of a carton blank of the present invention.
Figure 7:
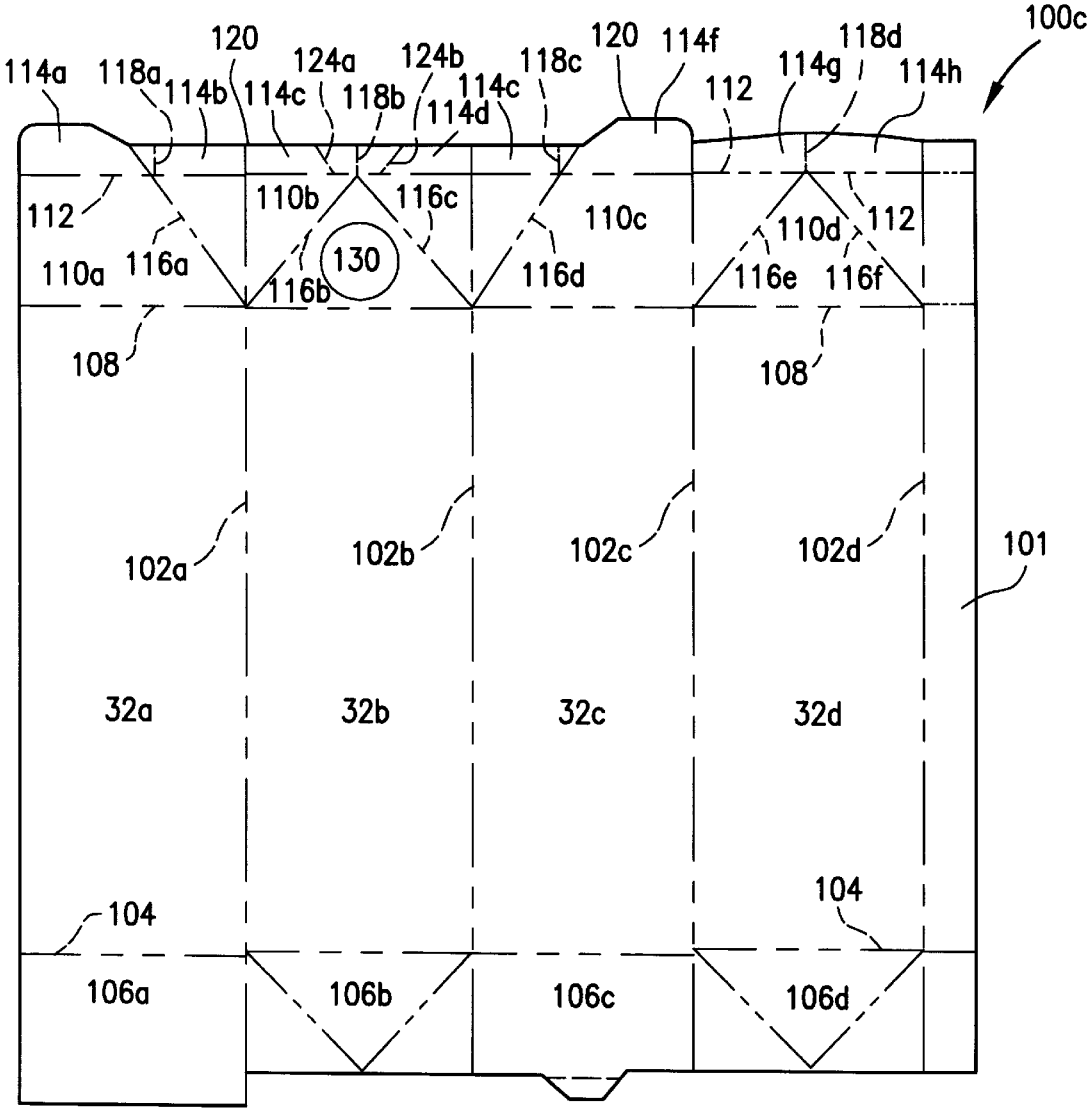
FIG. 7 is an alternative embodiment of a carton blank of the present invention.

FIGS. 5–7 illustrate carton blanks 100*a–c* for the various embodiments previously illustrated. The carton blank 100*a* of FIG. 5 corresponds to the carton top 22*a* of FIGS. 2 and 2A. The carton blank 100*b* of FIG. 6 corresponds to the carton top 22*b* of FIGS. 3 and 3A. The carton blank 100*c* of FIG. 7 corresponds to the carton top 22*c* of FIGS. 4 and 4A.

First the similarities of the blanks 100*a–c* will be discussed, then the differences of the blanks 100*a–c*. The blanks 100*a–c* have a plurality of side panels 32*a–d* partitioned from each other by a plurality of vertical score lines 102*a–d* which also partition a sealing panel 101 from the side panel 32*d*. A bottom horizontal score line 104 separates each of the side panels 32*a–d* from corresponding bottom panels 106*a–d*. A top horizontal score line 108 partitions the side panels 32*a–d* from a plurality of top panels 110*a–d*. On a second top panel 110*b,* an aperture 130 is disposed for placement of the fitment 30 thereabout when the carton 20 is partially-formed. A pair of diagonal score lines 116*b–c* create the triangular panel 40 on this top panel 11o*b*. Other diagonal score lines 116*a,* 116*d–f* are scored on some of the other top panels for folding purposes to create the unique top configuration. An upper horizontal score line 112 partitions the top panels 110*a–d* from a plurality of fin panels 114*a–h*. The fin panels 114*a–h* contain the differences between the various blanks 100*a–c*.

The fin panels 114*a,* 114*c,* 114*d* and 114*f–h* of the carton blank 100*a* of FIG. 5 are primarily distinguished from the other blanks 100*b–c* by the absence of fin panels 114*b* and 114*e*. Additionally, the fin panels 114*a* and 114*f* are of a greater height relative to the other fin panels. This symmetry about the top panel 110*b* allows for the top configuration 22*a* of FIGS. 2 and 2A.

The fin panels 114*a–h* of blank 100*b* of FIG. 6 are distinguished from the fin panels of the other blanks 100*a* and 100*c* by the similarity of each fin panel 114*a–h* except for cut-outs 122 and 123. The fin panels 114*a–h* are partitioned from each other by a plurality of fin vertical score lines 118*a–d*.

The fin panels 114*a–h* of blank 100*c* of FIG. 7 are distinguished from the fin panels of the other blanks 100*a* and 100*b* by the extensions of fin panels 114*a* and 114*f* and the inclination of fin panels 114*g* and 114*h*. The fin panels 114*a–h* are partitioned from each other by a plurality of fin vertical score lines 118*a–d*.

The edging 120 along the top of the blanks 100*a–c* varies to create the unique top configurations 22*a–c,* and assist in the folding of the carton blanks 100*a–c* into cartons 20. The folding operation is shown in FIGS. 8 and 9.

Figure 8:
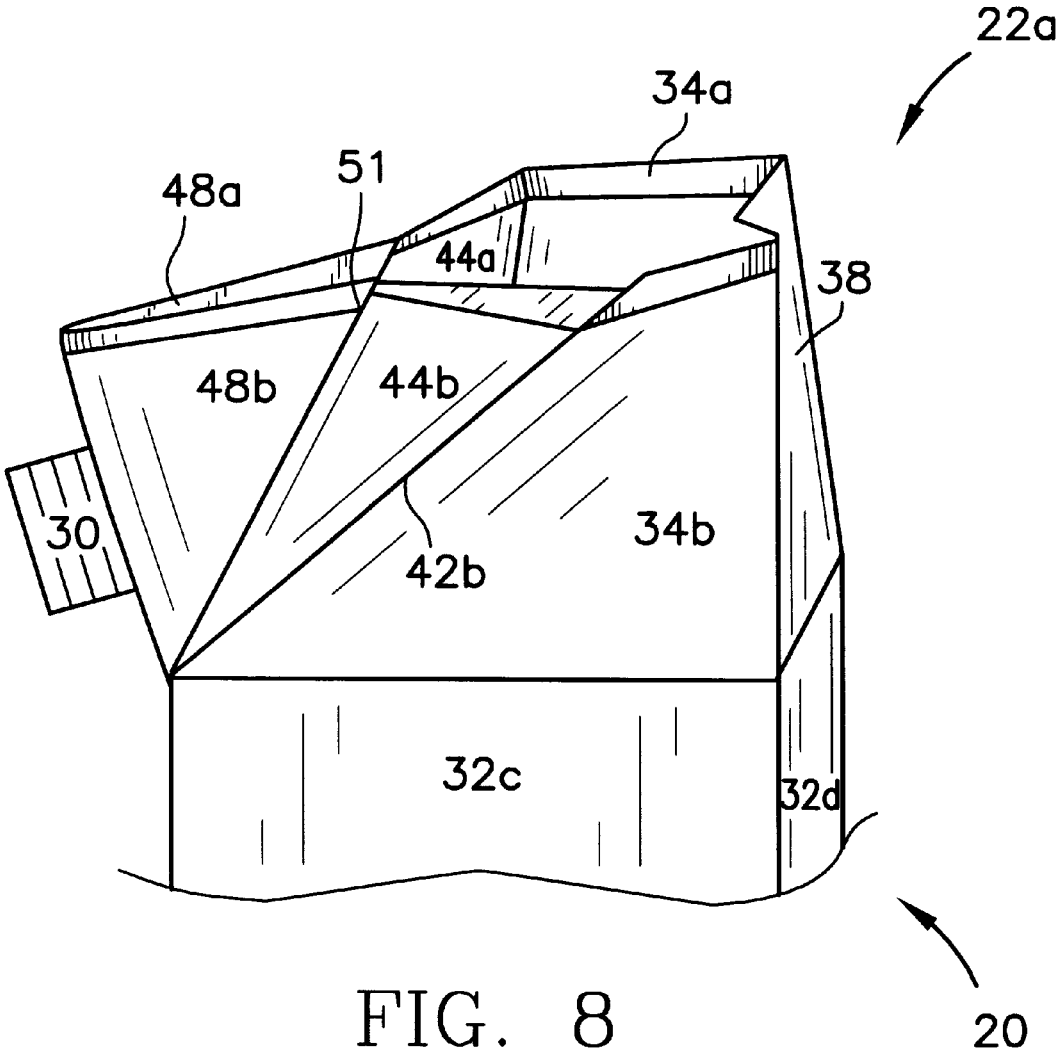
FIG. 8 is a perspective view of one step of the folding operation of the top of the carton of the present invention.

In FIG. 8, the top panels are undergoing folding into the top 22*a*. Reference is made specifically to folding flaps 44*a–b,* previously mentioned in the description of the top 22*c,* and folding flaps 48*a–b*. A fold line 51, only shown on one side, will move inward resulting in the inward movement of the folding flaps 44*a–b* and 48*a–b*. The top 22*a* will now resemble that shown in FIG. 9.

Figure 9:
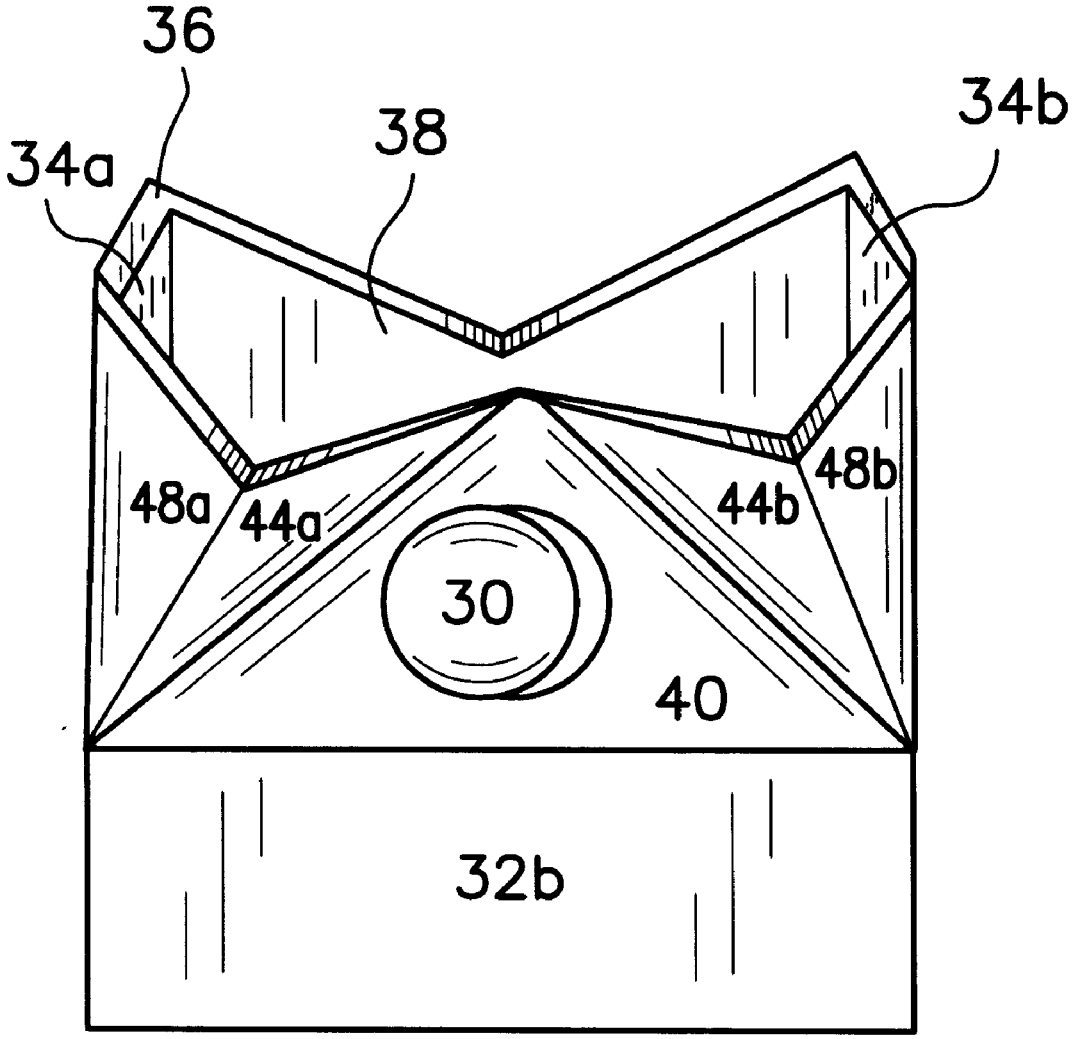
FIG. 9 is a perspective view of a second step of the folding operation of the top of the carton of the present invention.

In FIG. 9, as the panels that compose of the top fin 36 are brought together, the triangular panel 40 is drawn rearward. The folding flaps 44*a* and 48*a* overlap, and the folding flaps 44*b* and 48*b* overlap. The angled top panels 34*a–b* join to form the top fin 36, and folding lines 42*a–b* are created.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims:

We claim as our invention:

1. A carton for a liquid food product, the carton comprising:

first, second, third and fourth side panels, the first side panel opposite the third side panel and the second side panel opposite the fourth side panel;

first and second angled top panels, the first angled top panel adjacent the first side panel and the second angled top panel adjacent the third side panel, each of the angled top panels having a diagonal edge and a fin panel, each of the fin panels engaging to form a top fin that extends along a portion of a central plane of the carton;

a triangular top panel having first, second and third edges, the first edge adjacent the second side panel, the second edge engaging the diagonal edge of the first top panel, and the third edge engaging the diagonal edge of the second top panel, the triangular top panel having an aperture therethrough for accessing the liquid food product; and a closure disposed on the triangular top panel, the closure covering the aperture.

2. The carton according to claim 1 wherein the closure comprises a resealable cap, a threaded spout and a flange.

3. The carton according to claim 1 wherein the closure is a flip-cap closure comprising a resealable cap, a spout, a flange and a hinge connecting the cap to the flange.

4. The carton according to claim 1 further comprising a pair of folding flaps disposed on each side of the triangular top panel, each of the folding flaps folded onto one of the first or second top panels.

5. The carton according to claim 1 wherein the carton has a square cross-section.

6. The carton according to claim 1 wherein the carton has a rectangular cross-section.

7. A blank for fabrication into a carton for a liquid for product, the blank comprising:

first, second, third and fourth side panels partitioned from each other by a plurality of vertical score lines;

first, second, third and fourth top panels respectively adjacent the first, second, third and fourth side panels and separate therefrom by a horizontal score line, the first, second, third and fourth top panels partitioned from each other by the plurality of vertical score lines, the second top panel having first and second diagonal score lines intersecting each other at one end and intersecting a vertical score line of the plurality of vertical score lines at the other end, the second top panel also having an aperture therethrough, the second top panel also having a top fin panel, the top fin panel divided by a top fin vertical score line and having an edge with a depressive cut-out centered on the top fin vertical score line.

* * * * *